US007314340B2

(12) United States Patent
Chiang

(10) Patent No.: US 7,314,340 B2
(45) Date of Patent: Jan. 1, 2008

(54) DUAL-MODULE HOLE-PUNCHING AND BINDING MACHINE

(76) Inventor: Chou-Chih Chiang, No. 13, 23 st Rd., Taichung Ind. Park, Taichung (TW)

( * ) Notice: Subject to any disclaimer, the term of this patent is extended or adjusted under 35 U.S.C. 154(b) by 472 days.

(21) Appl. No.: 11/022,694

(22) Filed: Dec. 28, 2004

(65) Prior Publication Data

US 2006/0140744 A1 Jun. 29, 2006

(51) Int. Cl.
*B42B 5/00* (2006.01)
*B42B 5/08* (2006.01)
*B42B 5/10* (2006.01)

(52) U.S. Cl. ..... 412/33; 412/38; 412/39

(58) Field of Classification Search ..... 412/1, 412/6, 9, 16, 33, 34, 38–40; 83/618, 620, 83/633, 684, 687, 691; 270/52.17
See application file for complete search history.

(56) References Cited

U.S. PATENT DOCUMENTS 4,645,399 A * 2/1987 Scharer ..... 412/16
4,820,099 A * 4/1989 Battisti ..... 412/37
4,872,796 A * 10/1989 Hsieh et al. ..... 412/16
5,183,361 A * 2/1993 Ho ..... 412/16
5,211,522 A * 5/1993 Ho ..... 412/16
5,934,340 A * 8/1999 Anthony et al. ..... 140/92.94
6,079,924 A * 6/2000 Chiang ..... 412/33
6,887,025 B2 * 5/2005 Buhler et al. ..... 412/39
2003/0198536 A1 * 10/2003 Buhler et al. ..... 412/39
2004/0240968 A1 * 12/2004 Knight ..... 412/38

* cited by examiner

*Primary Examiner*—Monica Carter
*Assistant Examiner*—Pradeep C Battula

(57) ABSTRACT

A dual-module hole-punching and binding machine includes a housing, a first hole-punching unit, a second hole-punching unit, a pressing unit, a measurement unit, an adjustment unit and a coil piece affixing unit. The first hole-punching unit and second hole-punching unit have a first cutting unit and a second cutting unit, respectively. Either cutting unit has a plurality of cutting members, which are aligned and equally spaced and may be used to punch holes in a stack of paper. The pressing unit has an adjustment member, which may move along an adjustment rod and may be used to adjust the pressing displacement of the pressing member. The measurement unit has a plurality of notches, which are equally spaced and parallel to each other. A user may use the widths of these notches to measure the thickness of a stack of paper. The adjustment unit may be used to adjust the depth that the paper stack is placed into the machine. The coil piece affixing unit may be used to hold an open coil piece so that the open coil piece may be inserted and fitted into a stack of paper with holes.

13 Claims, 8 Drawing Sheets

DUAL-MODULE HOLE-PUNCHING AND BINDING MACHINE

BACKGROUND OF THE INVENTION

1. Field of the Invention

The present invention generally relates to a dual-module hole-punching and binding machine. More particularly, the present invention relates to a hole-punching and binding machine with two different hole-punching modes.

2. Description of the Related Art

To bind paper into a loose-leaf book or notebook, first, a row of holes are punched along a line near the edge of a stack of paper and then a coil piece is fitted into these holes to bind the paper all together.

As of now, a commercially available hole-punching machine usually has only one hole-punching mode. A user must select a proper type of such machine according to the thickness of the paper so as to ensure the free movement of the pages after a coil piece is fitted into the stack of paper.

Hence, users usually have to prepare two machines (either of them has its own hole-punching mode) to punch holes in stacks of paper with different thickness. Therefore, there is a need for the improvement of the machines in their structure or design.

Whence, the machines of prior art have many disadvantages and have imperfect design; these machines need to be improved.

To eliminate these disadvantages, the inventor has spent many years in the improvement of these machines and has come up with the present invention.

SUMMARY OF THE INVENTION

The present invention is to provide a dual-module hole-punching and binding machine with a first hole-punching unit and a second hole-punching unit. These two units provide two different hole-punching modes so that a user does not have to prepare two machines, and the machine is easy to use.

Further, the present invention is to provide a dual-module hole-punching and binding machine, wherein the cylindrical rod of its pressing unit is connected with an adjustment knob piece and a user may use the adjustment knob piece to adjust the pressing displacement of the pressing member. As such, open coil pieces in various sizes may be accurately pressed into closed coil pieces and the deformation and partial/insufficient closure of the loops of such coil pieces may be avoided.

Still, the present invention is to provide a dual-module hole-punching and binding machine, wherein the machine has a measurement unit to measure the thickness of a stack of paper that will be punched. Also, the distance between the predetermined punching holes and the edge of paper may be properly chosen so as to ensure the free movement of the pages after the coil piece is fitted into the stack of paper.

Still further, the present invention is to provide a dual-module hole-punching and binding machine, wherein a user may choose to actuate the cutting operation of any cutting member of the first hole-punching unit and the second hole-punching unit so as to ensure all holes are punched within the perimeters of the paper and to meet particular punching needs.

Accordingly, the dual-module hole-punching and binding machine of the present invention comprises a housing, a first hole-punching unit, a second hole-punching unit, a pressing unit, a measurement unit, an adjustment unit and a coil piece affixing unit.

The first hole-punching unit has a first handle pivotally connected to an open end of a first horizontal rod. The other end of the rod is connected with a first cutting unit having a plurality of first cutting members, which are lined up and equally spaced and may be used to punch holes in a stack of paper. A sliding actuating member is disposed above each of these cutting members, so that a user may be allowed to choose to actuate the cutting operation of any of these cutting members.

The second hole-punching unit has a second handle pivotally connected to an open end of a second horizontal rod. The other end of the rod is connected with a second cutting unit having a plurality of second cutting members, which are lined up and equally spaced and may be used to punch holes in a stack of paper. A sliding actuating member is disposed above each of these cutting members, so that a user may be allowed to choose to actuate the cutting operation of any of these cutting members.

The pressing unit has an L-shaped pressing member and a cylindrical rod disposed in the housing. Two transmission cog-wheels are fitted on the cylindrical rod at two positions near two side walls of the housing, respectively. The cylindrical rod has two rows of notches disposed at two positions abutting two cog-wheels respectively, so that two cog-wheels may engage with two rows of notches. A handle is fixedly connected with the cylindrical rod at the position where the rod meets the housing so that a user may use the handle to move the pressing member horizontally. The horizontal portion of pressing member has an inwardly sloped shape. An adjustment knob piece is fitted on the other end, that is the end opposite to the handle end of the rod so that a user may turn the knob piece to move an adjustment member along an adjustment rod, hence the distance between the sloped side of the pressing member and the adjustment member and the horizontal displacement of the adjustment member may be adjusted.

The measurement unit is located at the frontal side of the housing and is parallel to the pressing unit. The measurement unit has a plurality of notches equally spaced and arranged in an orderly fashion according to their widths; therefore, a user may use the widths of these notches to measure the thickness of a stack of paper.

The adjustment unit comprises a first adjustment knob to adjust the first hole-punching unit and a second adjustment knob to adjust the second hole-punching unit. A user may adjust the adjustment unit after the user visually estimates the distance between the predetermined punching holes and the edge of paper and by referring to the hole spacing reference table 11. Before a user carries out the punching, the user may use the first adjustment knob or the second adjustment knob to adjust a first paper depth adjustment member of the first hole-punching unit or a second paper depth adjustment member of the second hole-punching unit so as to adjust the depth that the paper stack is placed into the first hole-punching unit or the second hole-punching unit. As such, a predetermined distance between the holes and the edge of paper may be attained.

The coil piece affixing unit comprises a plurality of protrusions equally spaced and parallel to each other, so that an open coil piece may be held by the protrusions and that the open coil piece may be fitted into a paper stack with holes.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
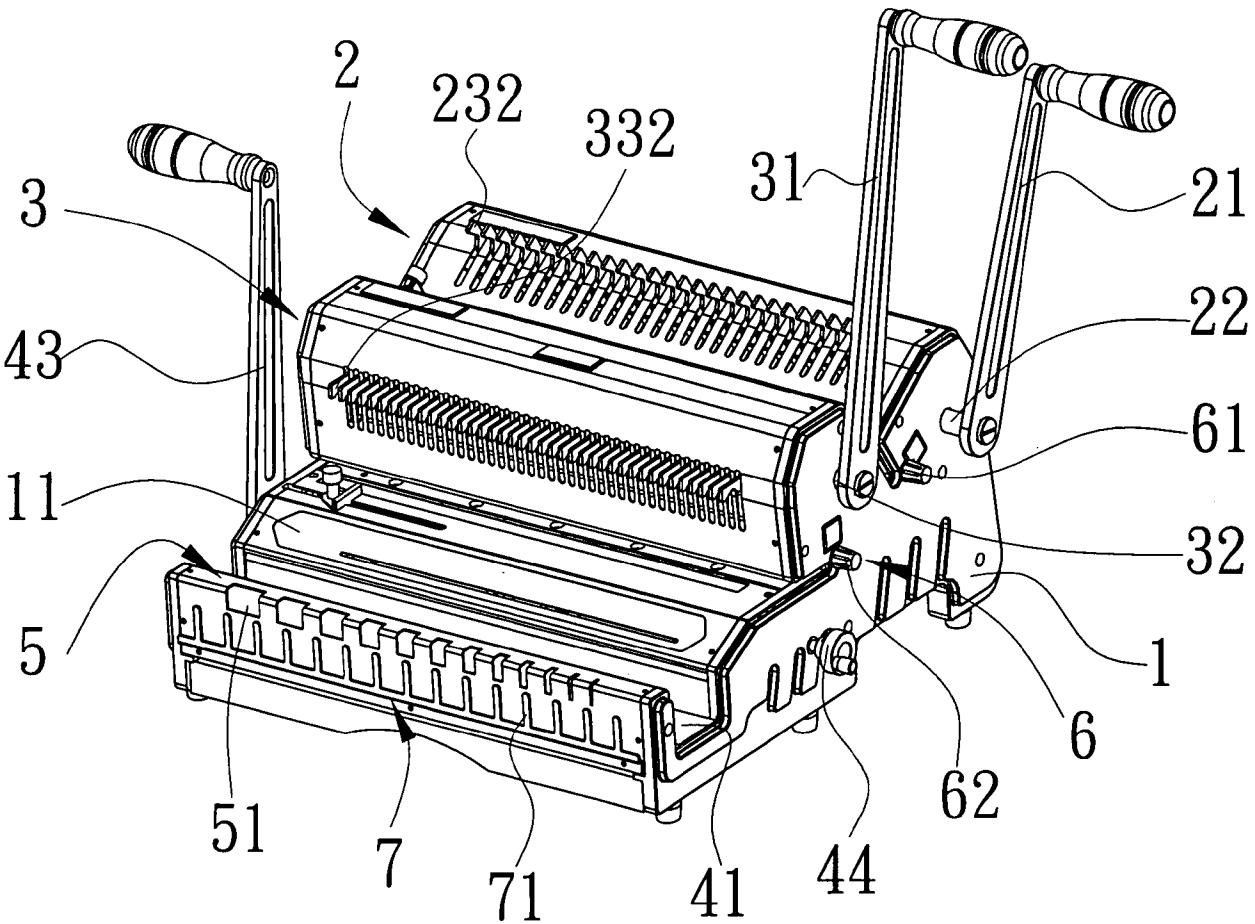
FIG. 1 is a right front perspective view of a dual-module hole-punching and binding machine of the present invention.

As illustrated in FIG. 1 to FIG. 9, a dual-module hole-punching and binding machine of the present invention comprises a housing 1, a first hole-punching unit 2, a second hole-punching unit 3, a pressing unit 4, a measurement unit 5, an adjustment unit 6 and a coil piece affixing unit 7.

Figure 2:
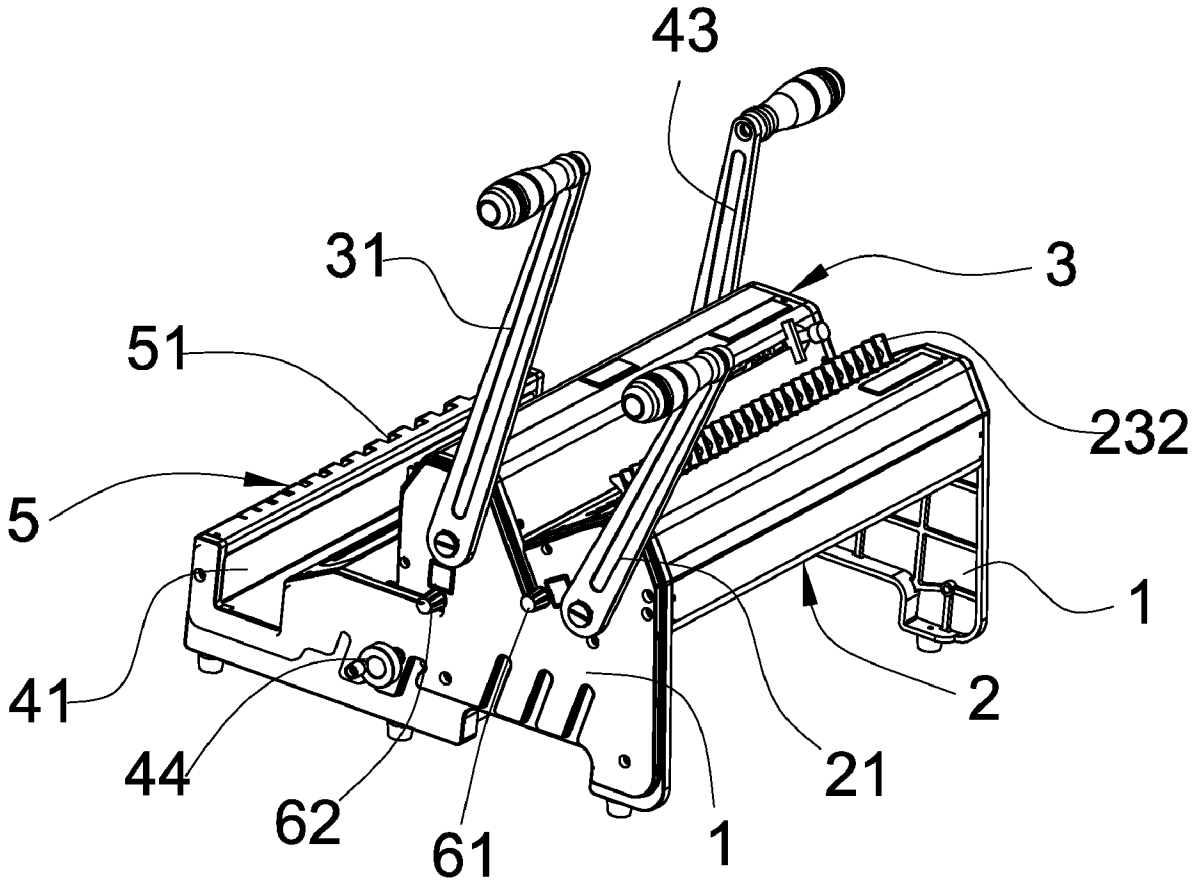
FIG. 2 is a right rear perspective view of the dual-module hole-punching and binding machine of FIG. 1.
Figure 3:
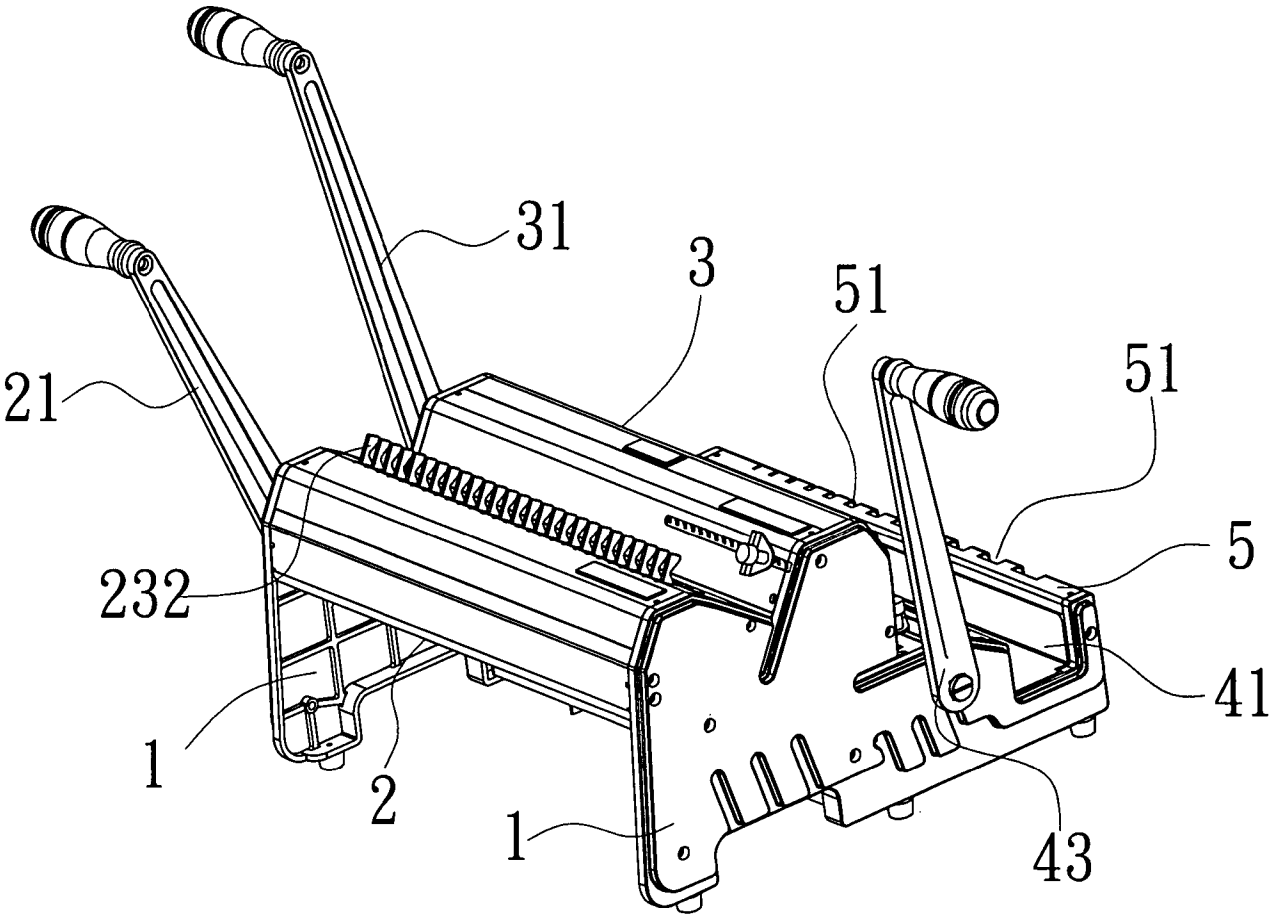
FIG. 3 is a left rear perspective view of the dual-module hole-punching and binding machine of FIG. 1.
Figure 4:
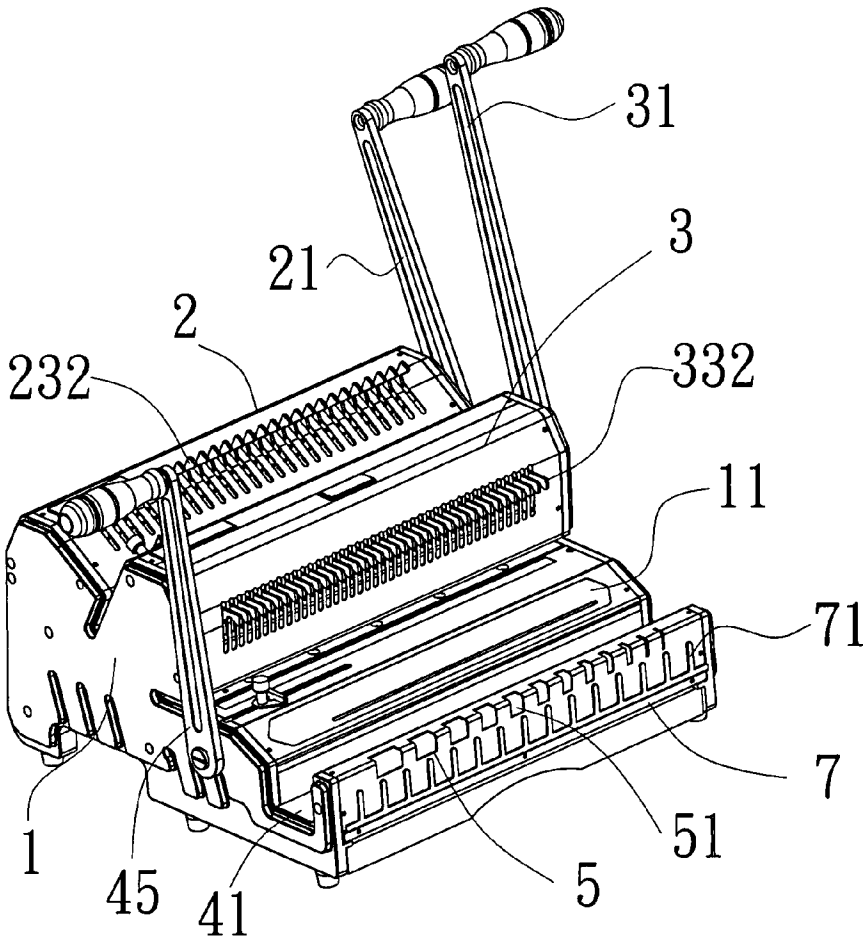
FIG. 4 is a left front perspective view of the dual-module hole-punching and binding machine of FIG. 1.
Figure 5:
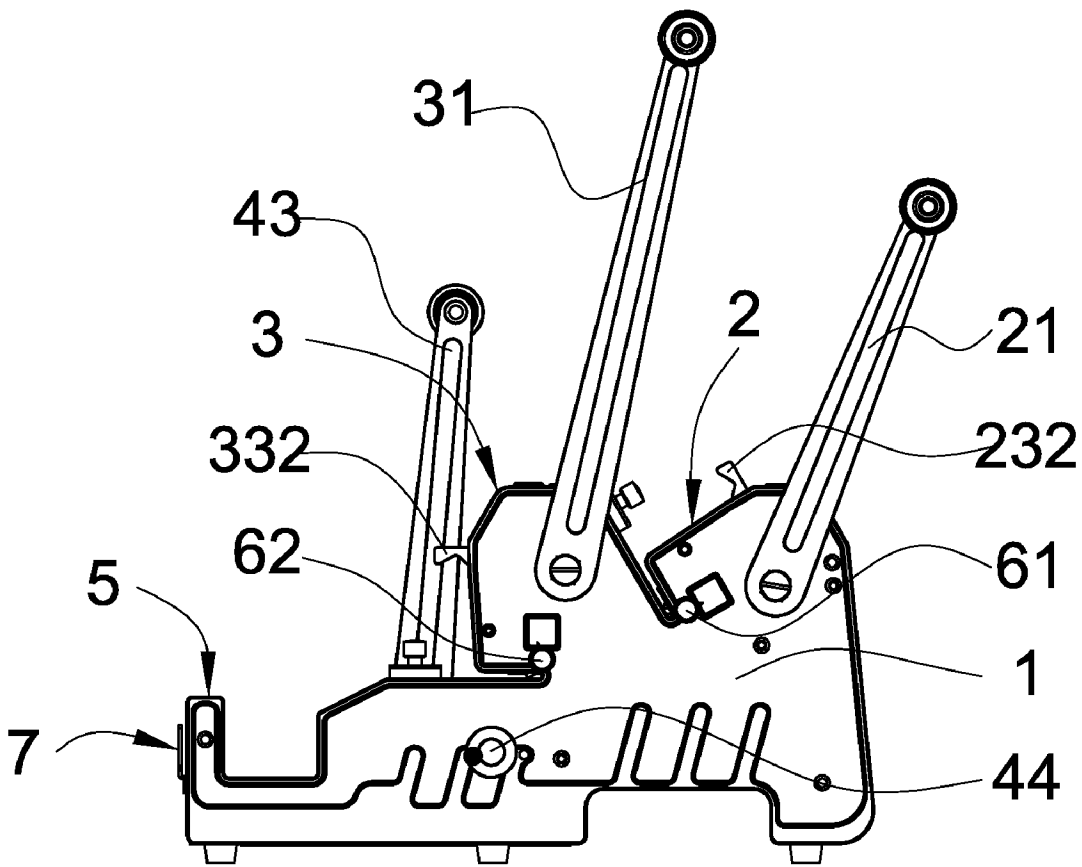
FIG. 5 is a side elevation view of the dual-purposed hole-module and binding machine of FIG. 1.
Figure 6:
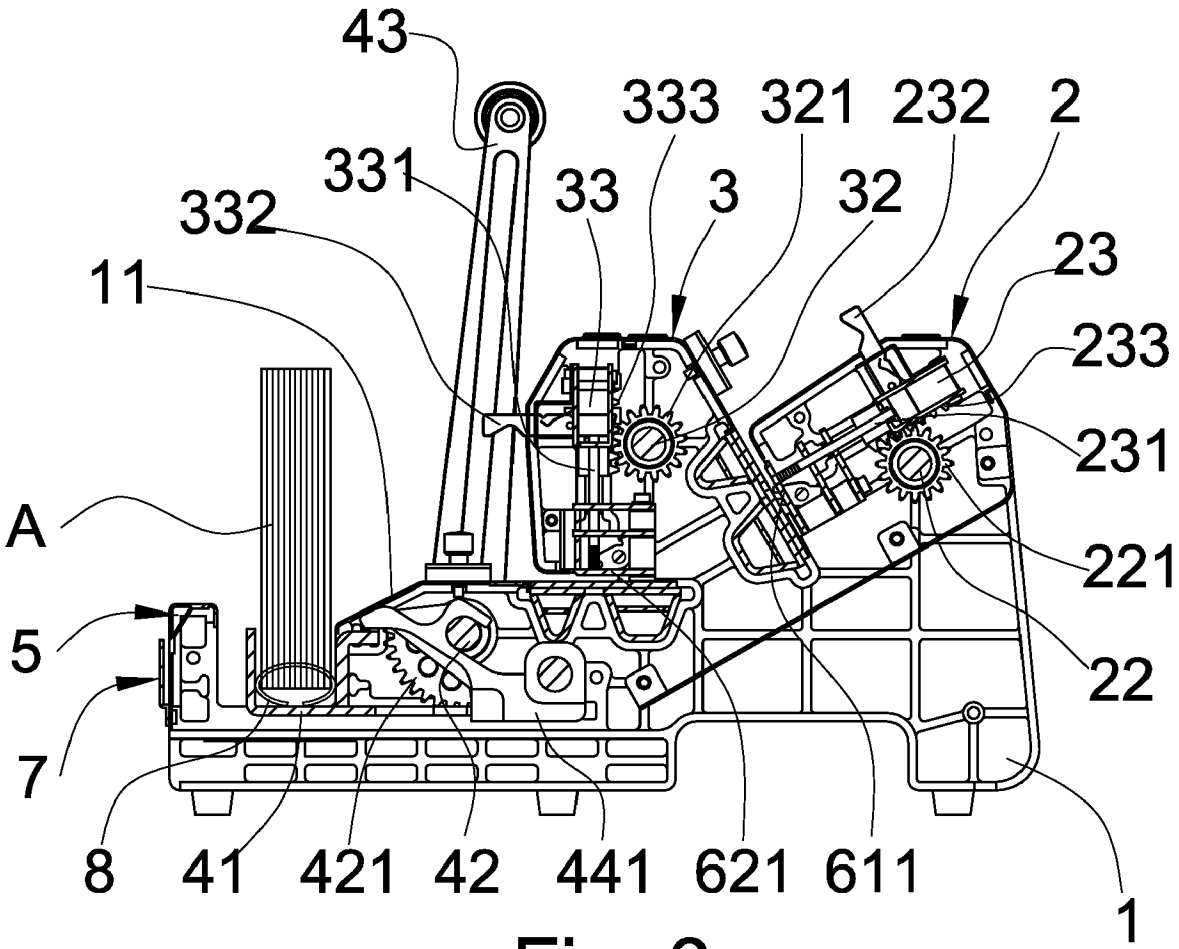
FIG. 6 is a cross-sectional view of the dual-module hole-punching and binding machine.

Referring to FIG. 2, the first hole-punching unit 2 has a first handle 21, which is pivotally connected to an open end of a first horizontal rod 22. The other end of the rod 22 is connected with a first cutting unit 23 having a plurality of cutting members 231, which are aligned and equally spaced and may be used to punch holes in a stack of paper A. These cutting members 231 of the first cutting unit 23 are arranged as that there are three cutting members 231 per inch of length. A sliding actuating member 232 is disposed above each of these cutting members, so that a user may be allowed to choose to actuate the cutting operation of any of these cutting members 231. Two first transmission cog-wheels 221 are fitted on the horizontal rod 22 and these two cog-wheels 221 are separated by a relatively large distance. A first row of teeth 233 is disposed on each of two locations corresponding to two first transmission cog-wheels 221 on the first cutting unit 23, so that each first row of teeth 233 may engage with the corresponding first transmission cog-wheel 221. When a user rotates the first handle 21, each row of teeth 233 engages with the corresponding cog-wheel 221 and the rod 22 is turned to move the cutting members 231 of the first cutting unit 23; therefore, the stack of paper A may be punched with holes as shown in FIG. 6.

The second hole-punching unit 3 has a second handle 31, which is pivotally connected to an open end of a second horizontal rod 32. The other end of the rod 32 is connected with a second cutting unit 33 having a plurality of cutting members 331, which are aligned and equally spaced and may be used to punch holes in a stack of paper A. These cutting members are arranged as that there are two cutting members 231 per inch of length. A sliding actuating member 332 is disposed above each of these. These actuating members 332 may be used to set the length of hole-punching operation since the cutting members 331 may be actuated by these actuating members. Two second transmission cog-wheels 321 are fitted on the horizontal rod 32 and these two cog-wheels 321 are separated by a relatively large distance. A second row of teeth 333 is disposed on each of two portions on the second cutting unit 33. When a user rotates the second handle 31, each row of teeth 333 engages with the corresponding cog-wheel 321 and the rod 32 is turned to move the cutting members 331 of the second cutting unit 33; therefore, the stack of paper A may be punched with holes as shown in FIG. 6.

Figure 7:
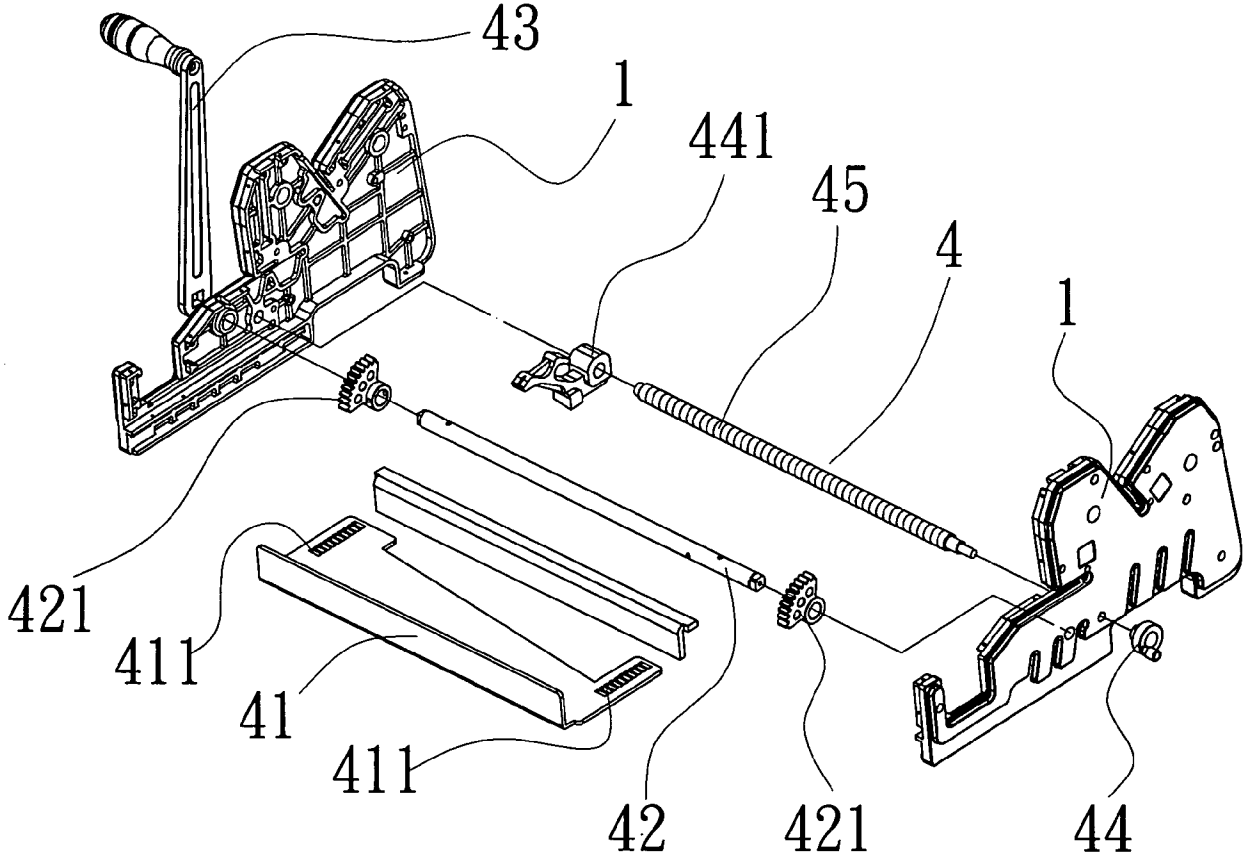
FIG. 7 is an exploded view of the pressing unit.
Figure 8:
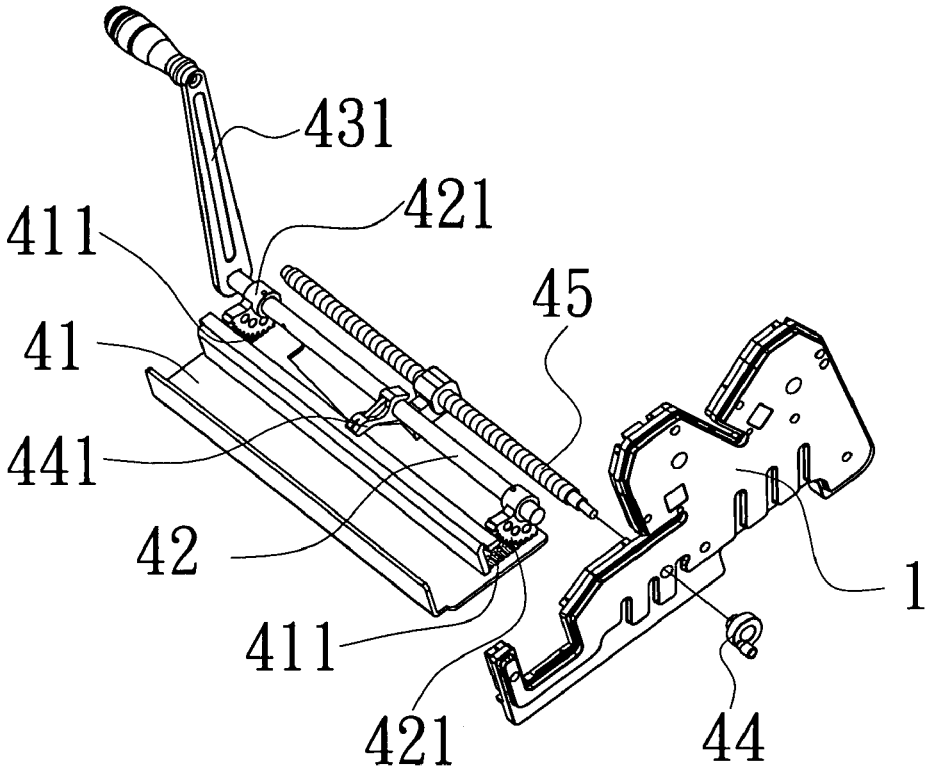
FIG. 8 is a diagram of the pressing unit of the dual-module hole-punching and binding machine, schematically illustrating the pressing unit that has been assembled.
Figure 9:
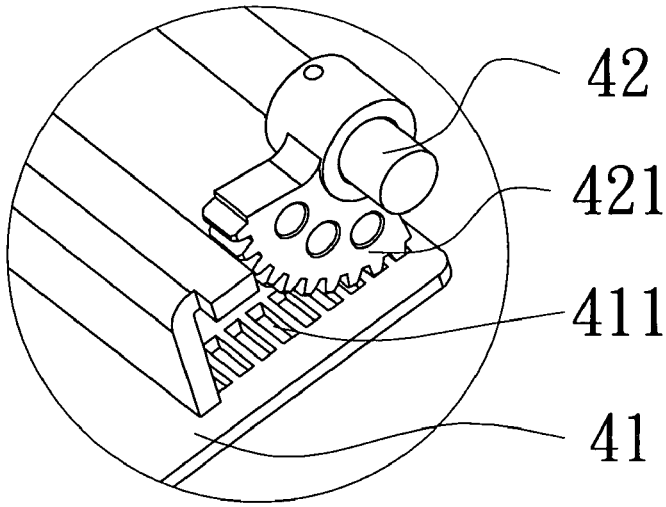
FIG. 9 is a partially enlarged diagram of the pressing unit.

The pressing unit 4 has an L-shaped pressing member 41, as shown in FIG. 7 to FIG. 9, and a cylindrical rod 42 disposed in the housing 1. Two transmission cog-wheels 421 are fitted on the cylindrical rod 42 at two positions near two side walls of the housing, respectively. The cylindrical rod 42 has two rows of notches 411 disposed at two positions abutting two cog-wheels 421, respectively. Hence, two cog-wheels 421 may engage with two rows of notches 411. A handle 43 is fixedly connected to the cylindrical rod 42 at the position where the rod 42 meets the housing. A user may use the handle 43 to move the pressing member 41 horizontally. The horizontal portion of pressing member 41 has an inwardly sloped shape. An adjustment knob piece 44 is fitted on the other end, that is the end opposite to the handle end of the rod 42. A user may turn the knob piece 44 to move an adjustment member 441 along an adjustment rod 45; hence, the distance between the sloped side of the pressing member 41 and the adjustment member 441 and the horizontal displacement of the adjustment member 441 may be adjusted.

The measurement unit 5 is located at the frontal side of the housing 1 and is parallel to the pressing unit 4. The measurement unit 5 has a plurality of notches 51, which are equally spaced and are arranged in an orderly fashion according to their widths. Hence, a user may use the widths of these notches 51 to measure the thickness of a stack of paper A.

The adjustment unit 6 comprises a first adjustment knob 61 to adjust the first hole-punching unit 2 and a second adjustment knob 62 to adjust the second hole-punching unit 3, as illustrated in FIG. 1. A user may adjust the adjustment unit after the user visually estimates the distance between the will-be-punched holes and the edge of paper and by referring to the hole spacing reference table 11. Before a user carries out the punching, the user may use the first adjustment knob 61 or the second adjustment knob 62 to adjust a first paper depth adjustment member 611 of the first hole-punching unit 2 or a second paper depth adjustment member 621 of the second hole-punching unit 3 and hence to adjust the depth that the paper stack A is placed into the first hole-punching unit 2 or the second hole-punching unit 3. As such, a predetermined distance between the holes to be punched by the cutting members 231 or the cutting members 331 and the edge of paper may be attained.

The coil piece affixing unit 7 comprises a plurality of protrusions 71, which are equally spaced and are parallel to each other, so that an open coil piece 8 may be held by the protrusions 71 and that the open coil piece 8 may be fitted into a paper stack A with holes.

The following will be the directions to the usage of the dual-module hole-punching and binding machine of the present invention. First, measure the thickness of a stack of paper by the measurement unit 5. Then, determine either the first hole-punching unit 2 or the second hole-punching unit 3 will be used by referring to the spacing reference table 11. Now, adjust the first or second paper depth adjustment member 611 or 621 by using the first or second adjustment knob 61 or 62.

Thereafter, the usage will be explained by a stack of paper that should be punched by the first hole-punching unit 2.

Furthermore, place the stack of paper A in the first hole-punching unit 2 and make sure the edge of paper presses against the upper part of the first paper depth adjustment member 611. Select the punching length and move the sliding actuating member 232 to a proper position. Because the sliding actuating member 232 presses against the rear edges of the cutting members 231, these cutting members will not be able to move upwards and hence will be able to punch holes on the paper. Turn the first handle 21 to move the first horizontal rod 22. The cutting members 231 that are pressed against by the sliding actuating member 232 will punch holes on the paper, and the cutting members 231 that are not pressed against by the sliding actuating member 232 will move backwards and will not punch holes on the stack of paper A.

After holes are punched, place a coil piece 8 in the coil piece affixing unit 7 to fit the coil piece 8 into the punched paper.

As illustrated in FIG. 6, place the stack of paper A with the coil piece 8 into the pressing unit 4 in a vertical manner and with the coil piece facing down. Turn the adjustment knob piece 44 to move the pressing member 41 along the cylindrical rod 441 so as to adjust the distance between the sloped side of the pressing member 41 and the adjustment member 441. Turn the handle 43 to move the pressing member 41 so as to close the coil piece 8. Now, the coil piece 8 is securely affixed to the stack of paper A.

Compared to other similar machines of the prior art, the dual-module hole-punching and binding machine of the present invention has the following five advantages:

1. This machine has two hole-punching units to provide two types of punching modes. Hence, a user only has to have one machine of the present invention, instead of two of other machines, because these two punching modes are the modes provided by all of other machines commercially available in the market.
2. The cylindrical rod of the pressing unit has an adjustment member, which may be used to press against and accurately close a coil piece so as to ensure the coil piece is properly closed. In other word, a proper or accurate force will be exerted so as to avoid the deformation or the insufficient/partial closure of the loops.
3. This machine may be used for coil pieces that are made of metal or other materials; in contrast, most of other similar machines commercially available in the market may only be used for plastic coil pieces. Therefore, this machine has a wider rage of application.
4. The thickness of a stack of paper may be accurately measured and the distance between the to-be-punched holes and the edge of paper may be properly chosen so as to sure the free movement of the pages after the coil piece is fitted into the stack of paper and the loops are closed.
5. A user may choose to actuate the cutting operation of any of cutting members so as to ensure all holes are punched within the perimeters of the paper and to allow the user to adjust the spacing between the holes.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A dual-module hole-punching and binding machine, comprising:

a housing;

a first hole-punching unit having a first handle pivotally connected to an open end of a first horizontal rod, wherein the other end of the first horizontal rod is connected with a first cutting unit having a plurality of first cutting members;

a second hole-punching unit having a second handle pivotally connected to an open end of a second horizontal rod, wherein the other end of the second horizontal rod is connected with a second cutting unit having a plurality of second cutting members;

a pressing unit having a pressing member to adjust a pressing displacement of the pressing member and a cylindrical rod disposed in the housing;

a measurement unit located at front side of the housing and parallel to the pressing unit, having a plurality of notches for a user to measure the thickness of a stack of paper;

an adjustment unit having a first adjustment knob to adjust the first hole-punching unit and a second adjustment knob to adjust the second hole-punching unit; and a coil piece affixing unit having a plurality of protrusions equally spaced and parallel to each other, so that an open coil piece may be held by the protrusions and that the open coil piece may be inserted and fitted into the paper stack with holes.

2. The dual-module hole-punching and binding machine as in claim 1, wherein the first cutting members are aligned and equally spaced to punch holes in the stack of paper, and a sliding actuating member is disposed above each first cutting member so that a user is allowed to choose to actuate any one of the first cutting members.

3. The dual-module hole-punching and binding machine as in claim 1, wherein the second cutting members are aligned and equally spaced to punch holes in the stack of paper, and a sliding actuating member is disposed above each second cutting member so that a user is allowed to choose to actuate any of the second cutting members.

4. The dual-module hole-punching and binding machine as in claim 1, wherein the pressing member is L-shaped.

5. The dual-module hole-punching and binding machine as in claim 1, wherein two transmission cog-wheels are fitted on the cylindrical rod at two positions near two side walls of the housing respectively, the cylindrical rod has two rows of notches disposed at two positions abutting two cog-wheels respectively so that two cog-wheels engage with two rows of notches respectively, and a handle is fixedly connected to the cylindrical rod at the position where the rod meets the housing so that the user may use the handle to move the pressing member horizontally.

6. The dual-module hole-punching and binding machine as in claim 5, wherein the horizontal portion of pressing member has an inwardly sloped shape, and an adjustment knob piece is fitted on the other end which is opposite to the handle end of the rod so that a user may turn the knob piece to move an adjustment member along an adjustment rod, hence a distance between the sloped side of the pressing member and the adjustment member and the horizontal displacement of the adjustment member is adjusted.

7. The dual-module hole-punching and binding machine as in claim 1, wherein the notches of the measurement unit are equally spaced and arranged in an orderly fashion, hence the user may use widths of the notches to measure the thickness of the stack of paper.

8. The dual-module hole-punching and binding machine as in claim 1, wherein before the user carries out the punching, the user may use the first adjustment knob or the second adjustment knob to adjust a first paper depth adjustment member of the first hole-punching unit or a second paper depth adjustment member of the second hole-punching unit and hence to adjust the depth that the paper stack is placed into the first hole-punching unit or the second hole-punching unit, so that a predetermined distance between the holes and the edge of paper is attained.

9. The dual-module hole-punching and binding machine as in claim 1, wherein the cutting members of the first cutting unit of the first hole-punching unit are arranged as that there are three cutting members per inch of length.

10. The dual-module hole-punching and binding machine as in claim 1, wherein the cutting members of the second cutting unit of the second hole-punching unit are arranged as that there are two cutting members per inch of length.

11. The dual-module hole-punching and binding machine as in claim 1, wherein two first transmission cog-wheels are fitted on the first horizontal rod and are separated by a relatively large distance, and a first row of teeth is disposed on each of two locations corresponding to two first transmission cog-wheels on the first cutting unit, so that each first row of teeth engages with the corresponding first transmission cog-wheel and that the first horizontal rod is connected with the first cutting unit.

12. The dual-module hole-punching and binding machine as in claim 1, wherein two second transmission cog-wheels are fitted on the second horizontal rod and are separated by a relatively large distance, and a second row of teeth is disposed on each of two locations corresponding to two second transmission cog-wheels on the second cutting unit, so that each second row of teeth engages with the corresponding second transmission cog-wheel and that the second horizontal rod is connected with the second cutting unit.

13. The dual-module hole-punching and binding machine as in claim 1, wherein a hole spacing reference table is attached to the housing so that a user may adjust the adjustment unit after the user visually estimates the distance between the predetermined punching holes and the edge of paper by referring to the reference table.

* * * * *